United States Patent [19]

Thais et al.

[11] Patent Number: 4,547,981

[45] Date of Patent: Oct. 22, 1985

[54] SHOE WITH ANKLE PROTECTOR

[76] Inventors: William Thais, Rte. 2, Box 2, Dwight, Ill. 60420; William Kauth, 417 Bradley La., Normal, Ill. 61761

[21] Appl. No.: 604,674

[22] Filed: Apr. 27, 1984

[51] Int. Cl.[4] ..... A43B 7/20; A43B 5/00

[52] U.S. Cl. ..... 36/89; 36/114; 128/80 H; 128/166

[58] Field of Search ..... 36/89, 114, 115, 117, 36/58.5, 128; 128/80 H, 166

[56] References Cited

U.S. PATENT DOCUMENTS

| | | | |
|---|---|---|---|
| 3,408,754 | 11/1968 | Kueter | 36/117 |
| 3,613,273 | 10/1971 | Marquis | 36/89 |
| 4,411,077 | 10/1983 | Slavitt | 36/89 |
| 4,441,265 | 4/1984 | Burns et al. | 36/117 |
| 4,461,288 | 7/1984 | Curtis | 128/80 H |
| 4,489,719 | 12/1984 | Lapenskie | 128/80 H |

FOREIGN PATENT DOCUMENTS

| | | | |
|---|---|---|---|
| 916696 | 8/1954 | Fed. Rep. of Germany | 36/117 |

*Primary Examiner*—James Kee Chi

*Attorney, Agent, or Firm*—Ernest Kettelson

[57] ABSTRACT

A shoe with an ankle protector comprising a support panel along the lateral aspect or outwardly facing side of a shoe securely fastened to the shoe along the bottom edge of the support panel which extends from about mid-heel forwardly to the point on the shoe which is adjacent the distal joint of the wearer's fifth metatarsal, and an inelastic or non-stretchable strap extending from the rear edge of the support panel around the back of the shoe at an upwardly inclined angle, then forwardly across the upper part of the shoe along the medial aspect or inwardly facing side adjacent the medial malleolus of the tibia portion of the wearer's ankle, then around the front portion of the shoe and downwardly for connection of the strap to a forward portion of said support panel. The strap is adjustable after the shoe is put on to draw it up tightly against the inwardly facing side of the wearer's ankle at the medial malleolus of the tibia portion thereof to prevent inversion or turning in of the foot thereby preventing ankle sprains which result from such inversion or internal rotation of the ankle.

16 Claims, 7 Drawing Figures

FIG. 5
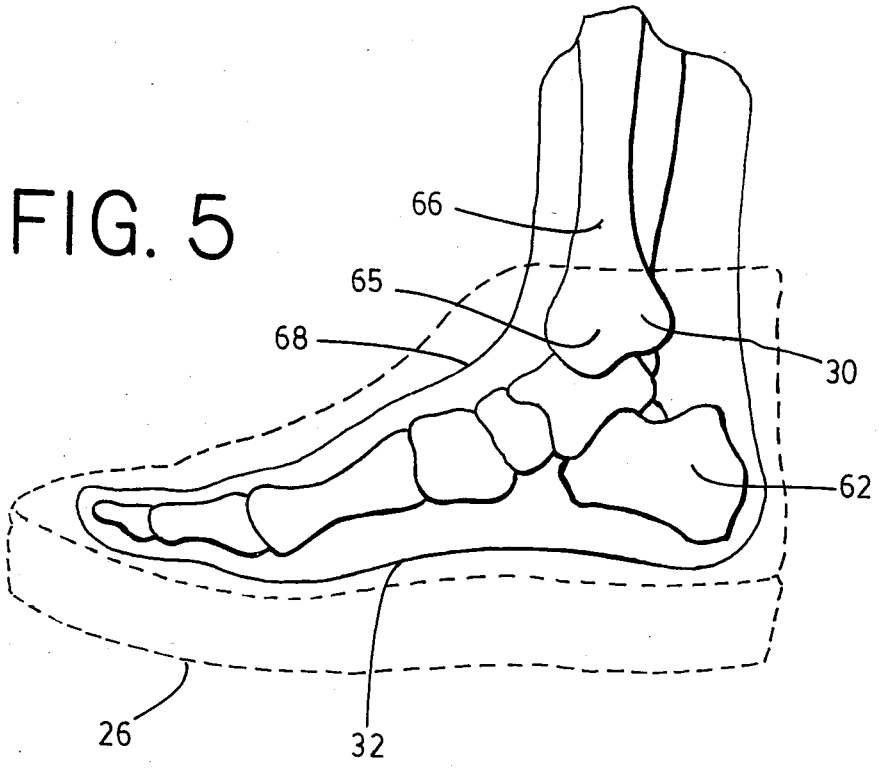
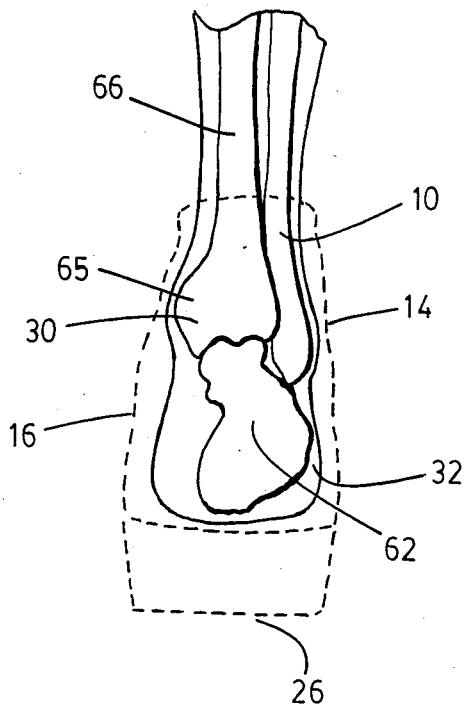
FIG. 6

SHOE WITH ANKLE PROTECTOR

BACKGROUND OF THE INVENTION

The invention relates to the field of supporting devices for footwear to prevent or minimize the risk of sprained ankles.

Prior art devices and methods for minimizing the risk of sprained ankles include taping of the ankle to immobilize it against internal rotation, or excessive internal rotation, which is the cause of most ankle sprains. Very few injuries to the muscles and tendons of the ankle occur from external rotation of the ankle, or turning of the foot outwardly which is also known as eversion or supination. Inward turning of the foot and internal rotation of the ankle is referred to as inversion or pronation.

Taping of the ankles of athletes is a time consuming and rather expensive procedure. It cannot be done properly by the athlete himself. A trainer with special knowledge of how to tape ankles properly is required in order to do that job in a way that will be reasonably effective in protecting the athlete's ankle.

Attempts have been made to incorporate support members and braces into shoes, but those known to the prior art have not been successful in preventing the internal rotation of the ankle which is the basic cause of ankle sprain. An illustrative example of prior art devices of this kind is shown in U.S. Pat. No. 4,411,077, which uses two elastic straps. However, the use of elastic straps permits the ankle to still rotate internally whereby sprain can still result. The present invention uses an inelastic non-stretchable strap which effectively prevents internal rotation of the ankle that may result in a sprain. The strap in this prior art patent is also anchored to the lateral aspect or outwardly facing side of the shoe at a location and for a distance that is not effective, or less effective in preventing ankle sprains than the present invention. The outer support panel of the present invention is secured along its bottom edge to a lower side edge of the lateral aspect of the shoe between approximately mid-heel forwardly to the point on the shoe which is adjacent the distal joint of the wearer's fifth metatarsal. This arrangement provides effective protection and anchoring points at the back and the front of such outer support panel for the inelastic strap to be properly placed against the inwardly facing side of the ankle, specifically against the medial malleolus of the tibia, in a direction substantially parallel to the sole of the shoe and the wearer's foot.

Another example of prior art attempts to solve problems by incorporating support members in a shoe is illustrated in U.S. Pat. No. 3,327,410. It discloses two strap members anchored to opposite sides of the sole on the inside of the shoe, but the opposite or free ends of the straps are merely wrapped around the leg in the ankle region and secured at that point rather than being anchored to the sole, or a panel or other part of the shoe which is anchored to the sole or bottom part of the shoe. Straps which are wrapped tightly around the leg and ankle also tend to cut off blood circulation, and furthermore impede flexation of the foot and ankle in other directions.

The present invention effectively solves these problems which are present with prior art devices. If effectively immobilizes the ankle against internal rotation, while at the same time leaving the foot and ankle free to move and flex in all of the other directions necessary during active play in athletic events and while engaging in other activities.

SUMMARY OF THE INVENTION

It is an object of the invention to provide a shoe with ankle protector which prevents internal rotation of the wearer's ankle to the degree it causes ankle sprain, but which does not prevent movement of the ankle and foot in other directions.

It is an object of the invention to provide a shoe with ankle protector which comprises an outwardly facing elongated panel secured to the sole or bottom edge of the shoe, an inelastic nonstretchable strap extending from the back of said elongated outwardly facing panel around the inwardly facing side of the shoe adjacent the inwardly facing ankle bone of the wearer and returning to the front portion of said elongated outwardly facing panel, the strap including tightening means to tighten the strap against the inwardly facing ankle bone of the wearer when the shoe is put on.

BRIEF DESCRIPTION OF THE DRAWING

FIG. 5 is a skeletal side elevation view of a person's right foot as viewed from the inward facing side, showing the tibia, the medial malleolus of the tibia, the heel bone, the tarsus bones, metatarsal bones, and phalanges as would be seen looking at the inward facing side of the foot, with the outline of a shoe shown in broken lines.

FIG. 6 is a skeletal end view from the back of the skeletal portion of the foot shown in FIG. 5.

DESCRIPTION OF PREFERRED EMBODIMENT

Figure 1:
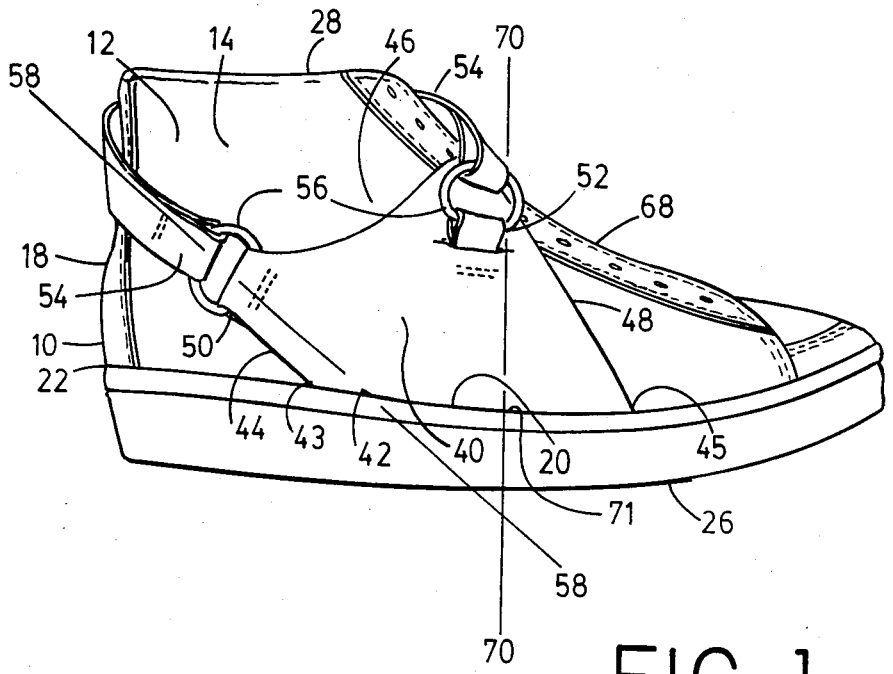
FIG. 1 is a side elevation view of a shoe for the right foot having an ankle protector in accordance with this invention, showing the outwardly facing side.
Figure 2:
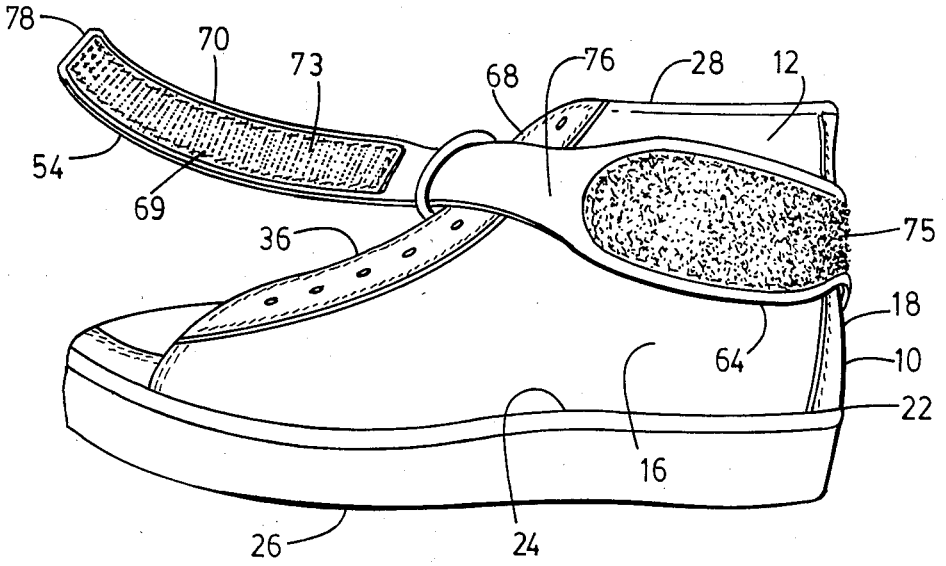
FIG. 2 is a side elevation view of the shoe and ankle protector shown in FIG. 1, showing the opposite or inwardly facing side and with the ankle protector in a partially unsecured or unfastened position.
Figure 3:
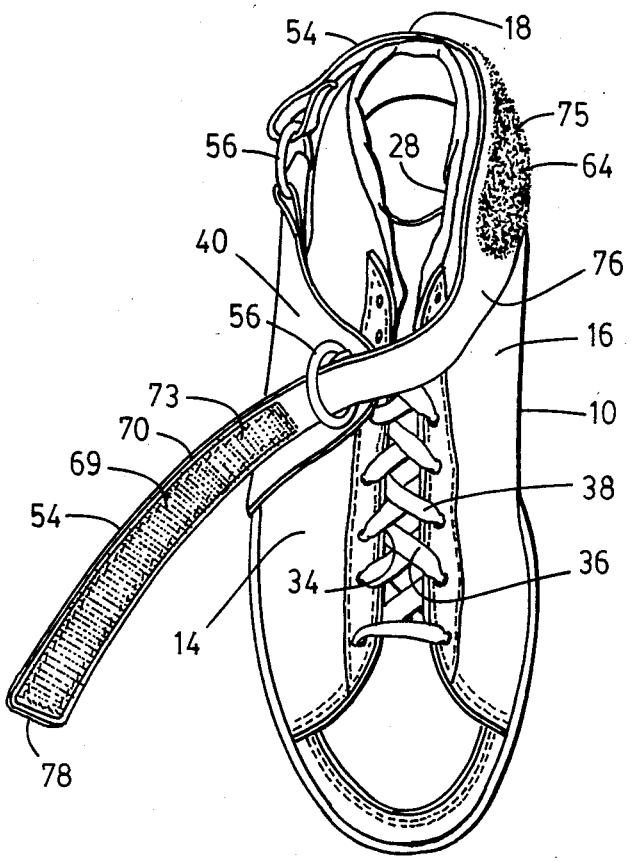
FIG. 3 is a top plan view of a shoe for the right foot having an ankle protector in accordance with this invention showing the strap of the ankle protector prior to doubling back on itself to secure the ankle protector in place for use.
Figure 4:
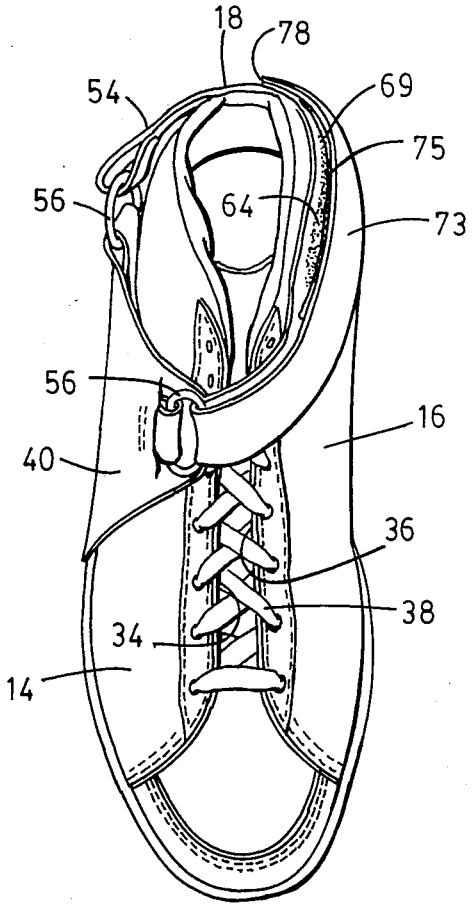
FIG. 4 is a top plan view of the shoe in FIG. 3 after the strap of the ankle protector has been doubled back and secured in place.
Figure 7:
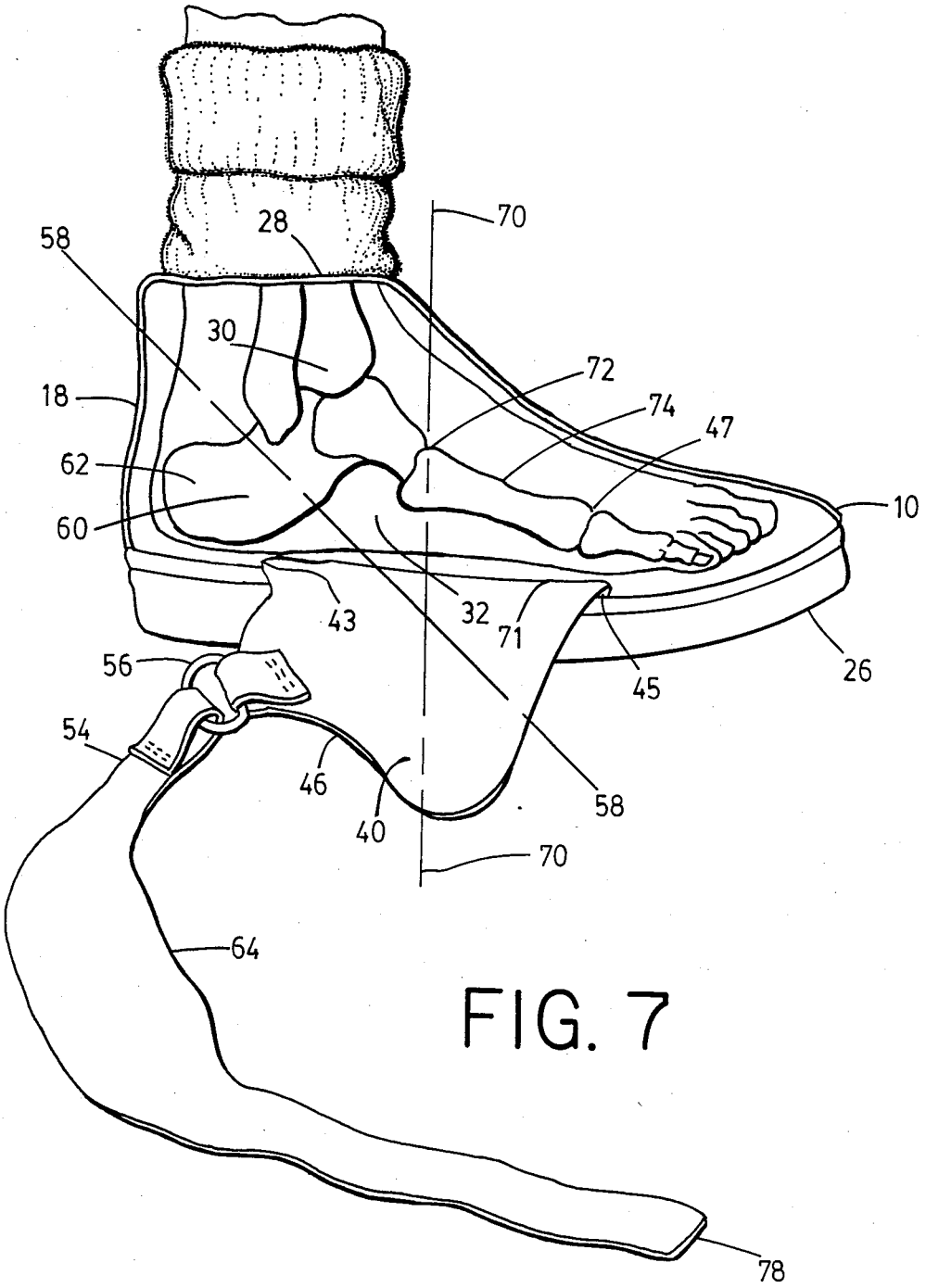
FIG. 7 is a skeletal side elevation view of a person's right foot as viewed from the outward facing side, showing the bones of the foot as would be seen from that side, with a shoe having an ankle protector in accordance with this invention shown in place on the foot but with its outer side wall broken away and the ankle protector folded downwardly to show the skeletal foot.

A shoe 10 in accordance with the present invention including an upper portion 12 comprising an outwardly facing side wall 14 and an inwardly facing side wall 16, both of which are integrally joined along the back wall 18 thereof. The upper portion 12 is joined along its bottom outwardly facing edge 20, rearwardly facing edge 22 and inwardly facing edge 24 to a sole 26. The upper portion 12 terminates along an upper edge 28 which lies just above the tibial-talus joint or ankle bone 30 of the wearer's foot 32 when the shoe is being worn. The upper edge 28 extends around both sides and the rear of the upper portion 12, and merges into the diagonally extending outer and inner free edges 34 and 36, provided with laces 38 to draw such free edges toward each other when the shoe is put on and ready for wear.

An elongated panel 40 is positioned along the outwardly facing wall 14 of the upper portion 12, the elongated panel 40 having a bottom edge 42, a back edge 44, a top edge 46 and a front edge 48.

The bottom edge 42 of elongated panel 40 is secured to the bottom outwardly facing edge 20 of upper portion 12 of the shoe 10, which adjoins the sole 26. The bottom edge 42 of elongated panel 40 preferably extends from about the mid-heel region 43 of the shoe 10 forwardly to about the point 45 on the shoe which is adjacent the distal joint of the wearer's fifth metatarsal 47.

The top edge 46 of elongated panel 40 extends longitudinally at a point just below the ankle bone 30 when the shoe 10 is being worn, and extends from a back anchor point 50 near the intersection of the back edge 44 and top edge 46 of panel 40, to a forward anchor point 52 near the intersection of the front edge 48 and the top edge 46 of the elongated panel 40.

An inelastic, non-stretchable strap member 54 is secured to the back anchor point 50 by a metal ring 56, although it may be secured by any other means including being integrally formed as an extending strap portion of elongated panel 40. The strap member 54 extends upwardly from the back anchor point 50 on a diagonal line 58, the downward extension of which intersects the sole 26 about the midpoint 60 of the heel bone 62 of the wearer's foot 32. The strap member 54 extends around the back wall 18 of the upper portion 12 of the shoe 10 in the same diagonal direction and then curves around to lie against the inwardly facing side wall 16 of the upper portion 12 of the shoe 10 in a substantially horizontal direction when the sole 26 is horizontal with the surface of the ground, or in a direction that is substantially parallel with the sole 26. The strap member 54 at this point includes an elongated section 64 which extends along the inwardly facing side wall 16 from approximately the back wall 18 to about the inner free edge 36 of the upper portion 12 of the shoe 10, the enlarged section 64 extending above and below the part of the shoe 10 which lies adjacent to the wearer's medial malleolus 65 of the tibia portion 66 of his ankle 30. The strap member 54 continues around the front portion 68 of the wearer's foot 32, and then is directed in a substantially vertical direction downwardly on a line 70 that intersects the sole 26 at a point 71 on the shoe 10 which is substantially adjacent to the proximal joint 72 of the wearer's fifth metatarsal 74 when the shoe 10 is being worn.

Another metal ring 56 may be provided at the forward anchor point 52 through which the strap member 54 extends, doubling back on itself for eventual fastening to hold securely after the strap member 54 has been tightened sufficiently to draw the enlarged section 64 of strap member 54 tightly against the wearer's medial malleolus 65 of the tibia portion 66 of his ankle 30.

The fastening means may take any convenient form. The fastening means found to be effective, inexpensive and non-complex is a Velcro strip 69 on the inwardly facing side 70 of the doubled back portion 73 of the strap member 54, and a corresponding connecting Velcro strip 75 on the outwardly facing side 76 of the enlarged section 64 of strap member 54.

In use, the shoe 10 is put on the wearer's foot 32, and a companion shoe on the wearer's other foot. The laces 38 are drawn tight. At this time the elongated panel 40 is adjacent the outwardly facing wall 14 of the upper portion 12 of the shoe 10. The strap member 54 is then drawn from the back of the shoe 10 and the back anchor point 50 in an upwardly diagonal direction and then longitudinally forward in a direction substantially parallel to the sole 26, with the elongated enlarged section 64 drawn tightly against that part of the shoe adjacent the wearer's inner ankle bone or medial malleolus 65 of the tibia 66. The leading end 78 of the strap member 54 is threaded through the ring 56 at the forward anchor point 52, then drawn up tightly and bent backwardly on itself pressing the Velcro strip 69 on the inwardly facing side 70 of the doubled-back portion 72 of strap member 54 against the corresponding Velcro strip 75 on the outwardly facing side 76 of the enlarged section 64 of strap member 54 to hold the two pieces together and the strap member 54 having its enlarged elongated section 64 in tight bearing engagement against that part of the inwardly facing side wall 16 of the upper portion 12 of the shoe 10 which lies adjacent to the wearer's inner facing ankle bone, specifically the medial malleolus 65 of the tibia 66.

The same is done with the companion shoe having the components of the present invention incorporated therein. The athlete or other wearer of the shoes in accordance with this invention is thereupon ready to engage in an athletic contest or other event with his ankles protected against injury from internal rotation thereof.

The elongated panel 40 is preferably of a flexible but inelastic and non-stretchable material such as leather. The strap member 54 is also of a flexible but inelastic and non-stretchable material such as leather. The elongated panel 40 may be secured along its bottom edge 42 to either the sole 26 or to the corresponding bottom edge 20 of the upper portion 12 of shoe 10 by stitching or other appropriate means.

We claim:

1. A shoe with ankle protector comprising a sole, an inwardly facing shoe side wall having a bottom edge secured to said sole, an outwardly facing shoe side wall having a bottom edge secured to said sole, a first location point on said outwardly facing shoe side wall along its bottom edge adjacent the mid-heel region of a wearer's foot, a second location point on said outwardly facing shoe side wall along its bottom edge adjacent the distal joint of the fifth metatarsal of a said wearer's foot, a first connecting point associated with said shoe adjacent said outwardly facing side located between said first and second location points and nearer said first location point, a second connecting point associated with said shoe located between said first and second location points and nearer said second location point, said ankle protector including a strap member of flexible inelastic material extending upwardly from said first connecting point along said outwardly facing shoe side wall in angular alignment with said first location point, a rear portion of said strap member extending across from said outwardly facing shoe side wall to said inwardly facing shoe side wall, a portion of said strap member extending adjacent said inwardly facing shoe side wall in facing abutting relationship therewith and adjacent the inwardly facing side of the ankle bone of said wearer's foot in facing relationship therewith, said portion of said strap which lies adjacent to and in facing relationship with said ankle bone having a width broad enough to extend above and below that part of said shoe which lies adjacent to said wearer's ankle bone, said ankle bone being the medial malleolus of the tibia portion of said wearer's ankle, and a continuing front portion of said strap member extending across a front portion of said wearer's foot and downwardly to said second connecting point along said outwardly facing shoe side wall.

2. A shoe with ankle protector as set forth in claim 1, wherein said ankle protector includes an elongated panel of flexible inelastic material secured to said shoe along said outwardly facing shoe side wall, said elongated panel having a rearward edge near said first location point and a forward edge near said second location point, said first connecting point being on said elongated panel near said rearward edge thereof, said second connecting point being on said elongated panel near said forward edge thereof.

3. A shoe with ankle protector as set forth in claim 2, said ankle protector including strap adjusting means to adjust the length of that portion of said strap member which lies in abutting relationship against said shoe side walls when said shoe is being worn.

4. A shoe with ankle protector as set forth in claim 3, wherein said elongated panel of flexible inelastic material includes a loop member at said second connecting point, said strap adjusting means includes said loop member, said strap member being elongated and received through said loop member to a desired point, said strap member including co-operative securing means on each side of said loop when so received therethrough to hold said strap at said desired point when said co-operative securing means are brought into securing engagement with each other.

5. A shoe with ankle protector as set forth in claim 4, wherein said co-operative securing means include a first fastening strip affixed to said strap on one side of said loop, a second fastening strip affixed to said strap on the other side of said loop received therethrough, said first fastening strip including a plurality of hook members, said second fastening strip including a plurality of loop members to releasably receive said plurality of hook members and hold said strips and said portions of said strap to which they are affixed together in secured relationship.

6. A shoe with ankle protector as set forth in claim 1, wherein said portion of said strap member extending adjacent said inwardly facing shoe side wall in abutting facing relationship therewith and adjacent the inwardly facing side of the ankle bone of said wearer's foot in facing relationship therewith has an enlarged width relative to those adjacent portions of said strap member which extend longitudinally from each opposite end of said enlarged width portion.

7. A shoe with ankle protector as set forth in claim 1, wherein said flexible inelastic material of said strap member is leather.

8. A shoe with ankle protector as set forth in claim 2, wherein said flexible inelastic material of said strap member and of said elongated panel is leather.

9. A shoe with ankle protector as set forth in claim 2, wherein said elongated panel of flexible inelastic material includes a bottom edge adjacent to said bottom edge of said outwardly facing shoe side wall, said elongated panel being secured to said shoe along said bottom edge of said elongated panel.

10. A shoe with ankle protector as set forth in claim 6, wherein said enlarged width portion of said strap member extends adjacent the inwardly facing shoe side wall in abutting facing relationship therewith in a direction substantially parallel to said sole when said shoe is being worn.

11. A shoe with ankle protector, wherein said ankle protector comprises an inelastic supporting panel to bear inwardly against the medial malleolus of the tibia of the wearer when said shoe with ankle protector is being worn, said supporting panel having a forward facing edge and a rearward facing edge, said shoe includes a sole having an inwardly facing side edge facing inwardly in the same direction as said medial malleolus and an opposite inwardly facing side edge facing outwardly in the opposite direction, first inelastic connecting means to connect said forward facing edge of said supporting panel across the upper front part of the foot of said wearer to a portion of said sole along said opposite outwardly facing side edge thereof to press said supporting panel firmly against said medial malleolus, second inelastic connecting means to connect said rearward facing edge of said supporting panel across the rear part of said wearer's ankle to a portion of said sole along said opposite outwardly facing side edge thereof to press said supporting panel firmly against said medial malleolus, said inelastic connecting means substantially restraining said sole of said shoe and said wearer's foot thereon from lateral movement relative to said medial malleolus in said direction toward which said medial malleolus is facing when said shoe with said ankle protector is being worn.

12. A shoe with ankle protector as set forth in claim 11, wherein said supporting panel is made of leather and has an enlarged width extending above and below said medial malleolus.

13. A shoe with ankle protector as set forth in claim 11, including a flexible inelastic wall portion secured to said sole along said outwardly facing side edge, said first and second inelastic connecting means being connected to said flexible inelastic wall portion to thereby connect to said sole.

14. A shoe with ankle protector as set forth in claim 11, wherein said first inelastic connecting means includes a strap member of leather and said second inelastic connecting means includes a strap member of leather.

15. A shoe with ankle protector as set forth in claim 11, wherein said first inelastic connecting means includes means to adjust the tightening of said supporting panel against said medial malleolus.

16. A shoe with ankle protector as set forth in claim 13, wherein said flexible inelastic wall portion extends along said outwardly facing side of said sole from a forward point adjacent the fifth metatarsal of a wearer's foot rearwardly to a rearward point adjacent the mid-heel region of said wearer's foot, said first inelastic connecting means being connected to said flexible inelastic wall portion between said forward and rearward points at a location closer to said forward point, said second inelastic connecting means being connected to said flexible inelastic wall portion between said forward and rearward points at a location closer to said rearward point.

* * * * *

UNITED STATES PATENT OFFICE

CERTIFICATE OF CORRECTION

Patent No. 4,547,981 Dated Oct. 22, 1985

Inventor(s) William Thais and William Kauth

It is certified that error appears in the above-identified patent and that said Letters Patent are hereby corrected as shown below:

Column 1, line 65, change "If" to - -It- -

Column 6, line 15, change "inwardly" to - -outwardly- -

Signed and Sealed this

*Twenty-first* Day of *January 1986*

[SEAL]

*Attest:*

DONALD J. QUIGG

*Attesting Officer*

*Commissioner of Patents and Trademarks*